US005307941A

United States Patent [19]

Siegal

[11] Patent Number: 5,307,941

[45] Date of Patent: May 3, 1994

[54] FILE FOLDER CONVEYOR

[76] Inventor: Burton L. Siegal, 7605 N. Tripp, Skokie, Ill. 60076

[21] Appl. No.: 918,842

[22] Filed: Jul. 24, 1992

[51] Int. Cl.[5] ..... B42F 17/00

[52] U.S. Cl. ..... 211/11; 211/59.3; 211/120; 221/75

[58] Field of Search ..... 211/11, 59.3, 120; 221/75

[56] References Cited

U.S. PATENT DOCUMENTS

| | | | |
|---|---|---|---|
| 1,134,988 | 4/1915 | Bellinger . | |
| 1,275,717 | 8/1918 | Mendeck | 211/11 |
| 2,279,643 | 4/1942 | Silver . | |
| 2,619,233 | 11/1952 | Weiskopf . | |
| 2,812,862 | 11/1957 | Cullen, Jr. | 211/11 |
| 2,867,161 | 1/1959 | Padgett . | |
| 3,057,511 | 10/1962 | Mannhardt | 221/75 |
| 3,591,045 | 7/1971 | Sturrock | 221/75 |
| 3,952,915 | 4/1976 | Pitel et al. | 221/75 |
| 3,986,637 | 10/1976 | Wittern et al. | 221/75 |
| 3,993,215 | 11/1976 | Cox et al. | 221/75 |
| 4,312,460 | 1/1982 | Boettcher | 221/75 |
| 4,314,418 | 2/1982 | Narens et al. | 211/11 |
| 4,600,119 | 7/1986 | Olson | 221/75 |
| 4,757,915 | 7/1988 | Albright et al. | 221/75 |
| 4,844,294 | 7/1989 | Albright | 221/75 |
| 4,969,561 | 11/1990 | Yang | 211/59.2 |
| 5,064,092 | 11/1991 | Grossi | 221/75 |
| 5,070,986 | 12/1991 | Hoffman et al. | 221/75 |

*Primary Examiner*—Paula A. Bradley
*Assistant Examiner*—Chuck Y. Mah
*Attorney, Agent, or Firm*—Hill, Steadman & Simpson

[57] ABSTRACT

A file folder conveyor which comprises a rotatable spiral mounted in a base that has opposite ends and has a back wall which extends higher than the front wall such that as the spiral is rotated, files can be moved which rest in the spiral and extend out of the front of the base so that they can be easily removed by a user. The spiral may be driven manually or by a motor means.

9 Claims, 3 Drawing Sheets

FILE FOLDER CONVEYOR

BACKGROUND OF THE INVENTION

1. Field of the Invention

This invention relates in general to office equipment and particularly to a novel file folder conveyor for storing and moving files.

2. Description of Related Art

U.S. Pat. No. 2,279,643 discloses a non-rotating spiral which is used for a mail dispenser, but it does not rotate. U.S. Pat. No. 4,969,561 discloses a diary reminder, but it does not have a base with different heights with continuously rotating dispensing device with side walls. See also U.S. Pat. Nos. 2,619,233, 5,070,986, 5,064,092, 4,757,915, 4,844,294, 4,600,119, 1,134,988, 4,312,460 and 2,867,161.

SUMMARY OF THE INVENTION

The present invention comprises a universal organizer of in-process paper work that can be used in almost every office in the world to replace the IN and OUT boxes. The present invention comprises a rotatable spiral which does not dispense or eject the file being processed, but does in contrast to the static coil spring storage devices move all of the files as commanded by the operator. The invention is intended to be used at desk height or above requiring that the files be added or removable be done so from the side as contrasted to the top of the device and, thus, the invention requires that the side be unobstructed. The invention requires one restraining side wall opposite that side used for load/unloading and requires that the rotational direction and "hand" of the spring be selected so that the frictional side force vector be directed to urge the file folders against said side wall and the hand of the spring be selected to minimize the frictional drag against the restraining side wall.

The invention relates to the manipulation and transport of paper documents contained in manila file folders or hanging type folders. Individual documents could possibly be accommodated, but the likelihood of multiple pages being shingled, distended or even damaged gives rise to the preferred embodiment. These conventional and/or hanging file folders are almost universal in their use to contain related documents while in process or storage. Since conventional file folders are now found with top or side filing tabs, the invention's lack of a second side wall is particularly important. The invention does not dispense, but it can move the file folders by either pulling toward or pushing away from the powered end. The other end can be constrained and guided for better control of the file folders. The invention may be powered by a fixed or retractable crank arm or, alternatively, can be driven by a motor such as an electric powered gear motor. Because of the purpose and the resultant weight of files being controlled, the horizontal and vertical slide surfaces that contact the edges of the file folders should have low friction and be wear resistant.

The invention may utilize one large or two or more small springs as the transport means. In the latter case, they can move in opposite directions, but in the preferred embodiment they should rotate in the same direction so that their frictional horizontal force vector will both contribute toward urging the file folders toward the side restraining wall.

The invention can be used in several ways, but assuming that office workers usually complete work on one file at a time, but often add several files to their back log at the same time, the most efficient way to use the device would be to have the "pull" point at the end of travel of the group of files in the device. This would assure that there would be a maximum of available coils for incoming files and the user could tap the "advance" switch in almost the same motion as reaching for and pulling the file to be worked upon. A slow acting, low powered and quiet gear motor could be used to drive the coil since the operator would be occupied with other activities and not be waiting for it to advance one coil pitch. If the work is such that there is a chance of the file being returned to the device before being disposed of, the operator could leave one coil empty at the end by merely waiting to pull the second file of the day before touching the "advance" switch. The device would advance the files one coil pitch and then stop, leaving a vacant coil at the end.

The length of the file provides a readily visible indicator of the back log of the operator allowing a supervisor to more efficiently and fairly distribute additional work. The exposed side of the device is base may have a labeling provision allowing a means of quantitizing the degree of the back log using numbers or hours, days, weeks or months.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
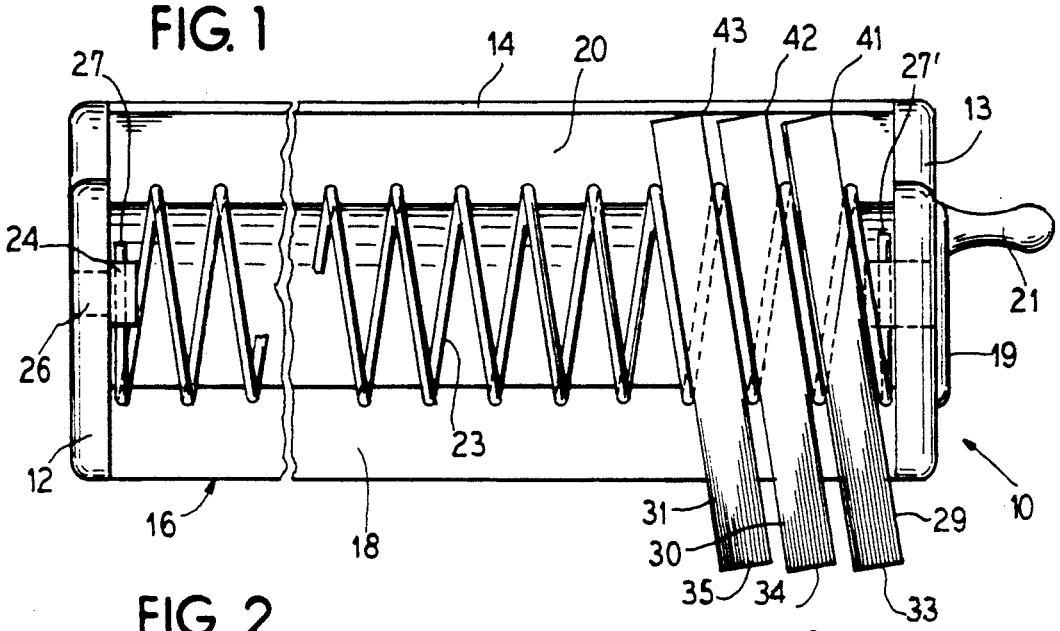
FIG. 1 is a top plan view of the invention.
Figure 2:
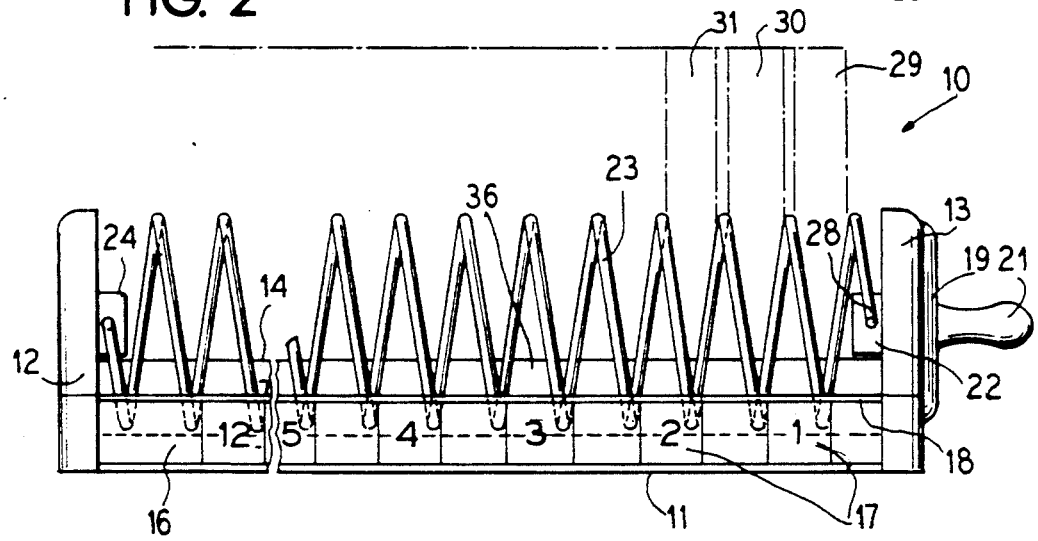
FIG. 2 is a side view of the invention.
Figure 3:
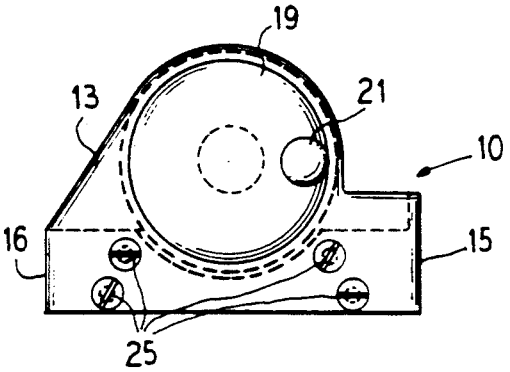
FIG. 3 is an end view of the invention.
Figure 4:
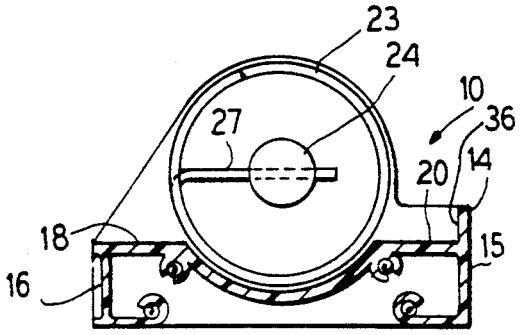
FIG. 4 is an end view from the other end of the invention.

FIGS. 1–4 illustrate the file folder conveyor 10 of the invention which comprises a bottom base member 11 which has opposite ends 12 and 13 between which a spiral 23 is rotatably mounted. Ends 12 and 13 are fastened to base member 11 with screws 25. One end of the spiral is mounted in a hub 24 which is mounted on a shaft 26 rotatably mounted and restrained in the end 12. The other end 28 of the spiral is mounted in a hub 22 which is connected to a disc 19 which has a handle 21 as shown in FIGS. 1, 2 and 3. The hub 24 is formed with an opening through which the end 27 of the spiral 23 extends. The opposite end 27' of the spiral 23 extends through a similar opening in the hub 22. The base has opposite sides 15 and 16. A side wall 14 is connected to upwardly extending portion 15 as shown in FIG. 4. Co-planar surfaces 18 and 20 form a flat surface for supporting folders.

Files 29, 30 and 31 can be mounted between the spirals of the coil 23 and the file folders will assume an angle equal to the pitch angle of the coils. Furthermore, the file folder edges 41, 42 and 43 will drag against the side wall 14 are receding so they will not dig in as they are pulled toward the source of power. To operate it in the other direction would increase the power required and the wear on the edges of the file folders. Although the choice of direction is optional, experiments have determined that the coils pull heavy loads much better than they push it. The top of the coil should always be moving toward the side wall relative to the surface of the file folders. This induces a frictionally transmitted thrust on the file folders keeping them in a uniform rank and their side edges rubbing upon the side wall 14.

The opposite file folder ends 33, 34 and 35 can and should overhang the base of the device to facilitate file removal and permit the device to be placed upon a shelf that is considerably less in depth than the width of the file folders. The vertical surface 36 of side wall 14 and surfaces 18 and 20 should have a smooth, low friction and wear resistant surface to facilitate the transport of the files with a minimum of effort. Viewed from the powered end, the crank 21 would be turned in the clockwise direction. As coil springs are designated, the coil transport member 23 would have a right hand wind. Moveable back log indicia 17 can be attached to surface 16 and would read from right to left. It is a natural ergonomic action to remove and crank to advance the balance of the files from the same end. In actual practice, the user will rarely crank after pulling a file. This is true for two reasons. First, he would have the pulled file in his hand and would have to lay it down to advance the balance. Second, which is more important and subtle, if the user advances the device immediately after pulling the file and he fails to complete work on the file he cannot return it to the head of the column. Thus, an experienced user will leave an empty coil at the "pull" end and simply advance the rank with his free hand just before pulling the next file. Since the side wall 14 is higher than the surface 20, the higher wall will cause the file to extend out beyond the front surface 18 as shown in FIG. 1.

Figure 7:
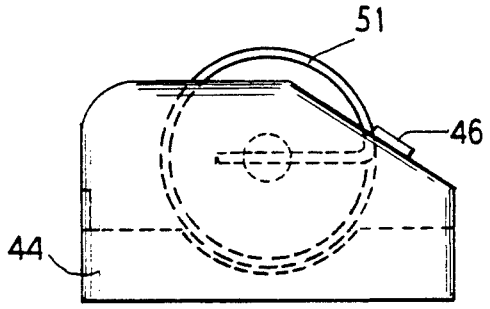
FIG. 7 is an end view of FIG. 5.

FIGS. 5, 6, 7 and 8 illustrate a modification of the invention which comprises a powered version. This embodiment is illustrated so as to move the files to the left or opposite the direction of the embodiment illustrated in FIGS. 1–4. A momentary advance switch 46 is placed in one end 44 such that the heel of the hand of a user can engage it while reaching to extract the next file folder 50. The coil 51 is rotatably supported between hubs 52 and 54 on opposite ends 43 and 44 of the file folder conveyor 41. The side wall 47 adjacent the horizontal surface 48 extends upwardly so that ends of the files 50 engage it. The horizontal surface 42 does not have a side wall analogous to side wall 47 so that files can extend out toward the user. The top of the coil 51 should rotate toward the side wall 47 and viewed from the powered end 60 this would required the coil 51 to rotate in a counter-clockwise direction. The hand of the coil should be "left" so as to ensure the files 50 are canted so that their side edges do not dig in to the side wall 47 as they move towards end 60. The moveable indicia 40 on the front surface of the base reads left to right in this embodiment. FIG. 7 is an end view of the embodiment illustrated in FIGS. 5 and 6.

Figure 5:
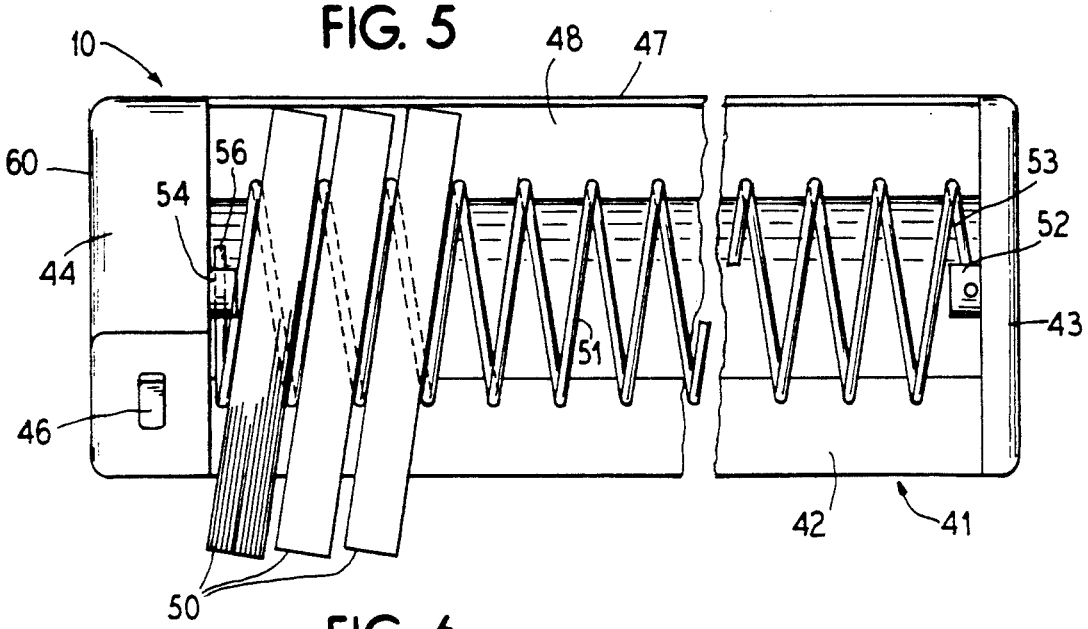
FIG. 5 is a top plan view of a modification of the invention.
Figure 6:
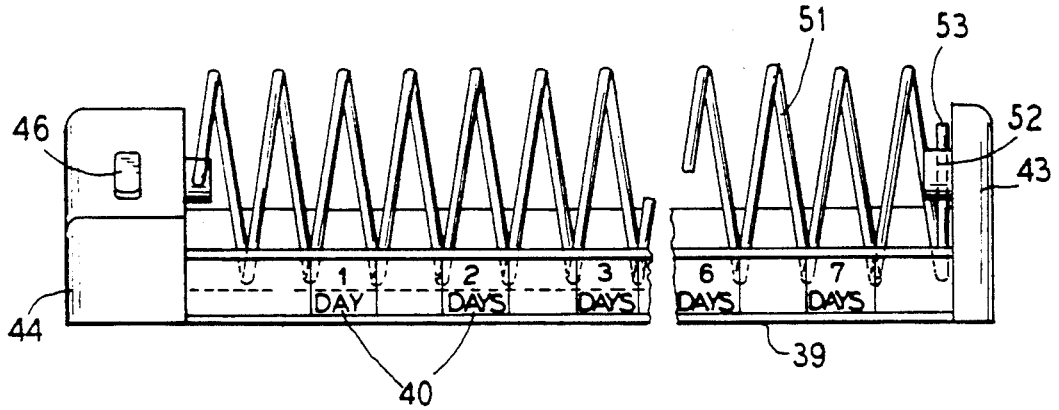
FIG. 6 is a side view of FIG. 5.
Figure 8:
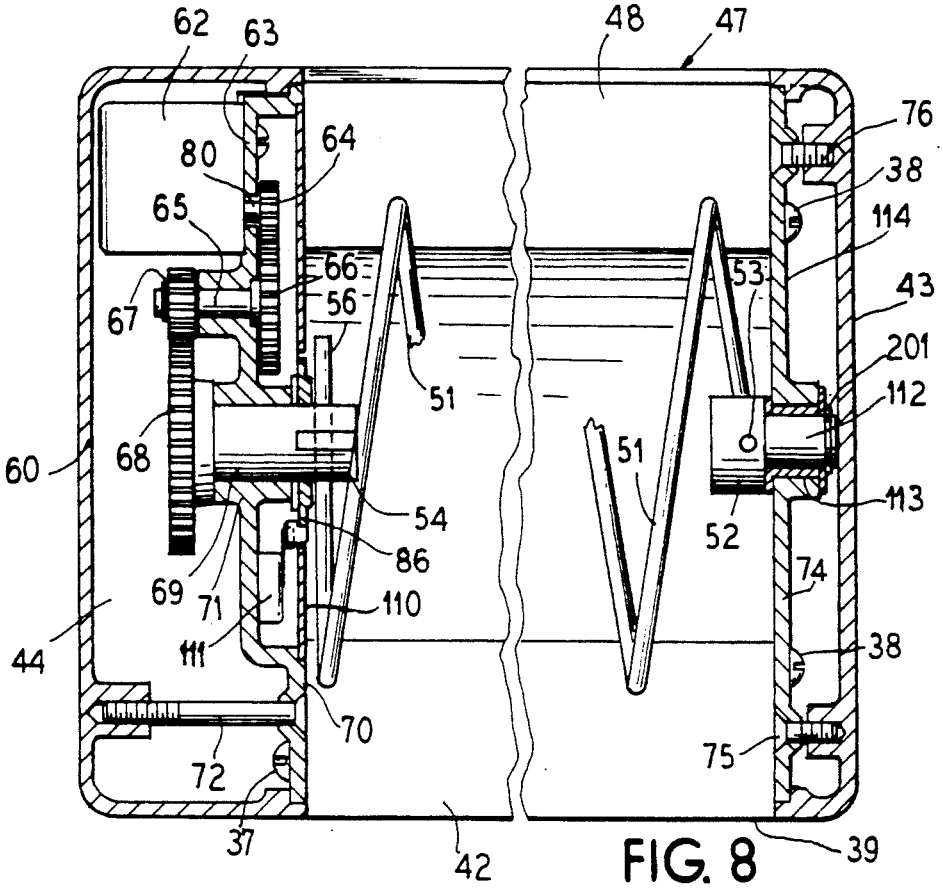
FIG. 8 is a sectional view of FIG. 5.

FIG. 8 is an enlarged sectional view of FIG. 5 with the center portion of the conveyor removed. The hub 54 is mounted on shaft 69 which is supported in a bearing 71. The shaft 69 carries a gear 68 which meshes with a gear 67 mounted on a shaft 65 which carries the gear 66 and is supported by bearing 61. A gear 64 is mounted on the output shaft 80 of a motor 62 and meshes with gear 66. The motor 62 is mounted on a wall 63 by bolts or other means as shown. Multiple bolts 72 extend into the end 60 and support it from frame member 70. The bearings 61 and 71 are mounted in member 70. The motor 62 might be a clock motor for example and drives the spiral 51. A cover plate 110 is mounted to and covers a recess formed in the frame member 70. A normally closed limit switch 111 is mounted behind the cover plate 110 and is acted upon by an extending actuator 86 which is keyed to and rotates with hub 54. Thus, the switch will be opened once on each revolution of hub 54 and it will stop the drive motor 52.

The other end of the spiral 51 has an end 53 mounted in the hub 52 which is mounted on the shaft 112 that is rotatably supported in a bearing 113 carried by frame plate 114. A retainer 201 keeps shaft 112 in its bearing 113. Bolts 75 and 76 attach the end 43 to the plate 114 of the conveyor. Frame plate 114 and frame member 70 are fastened to base member 39 with screws 38 and 37, respectively.

Figure 9:
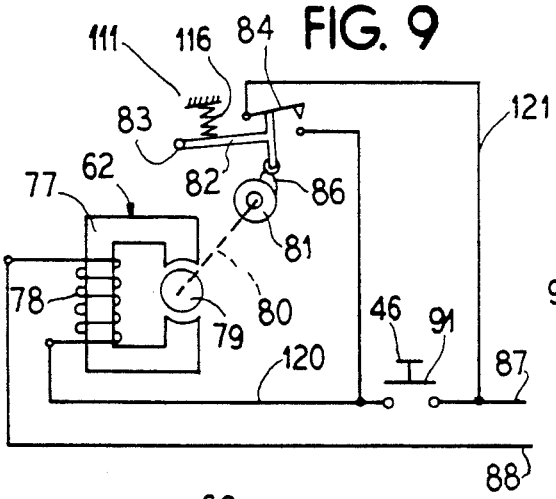
FIG. 9 illustrates an electrical schematic for the invention.
Figure 10:
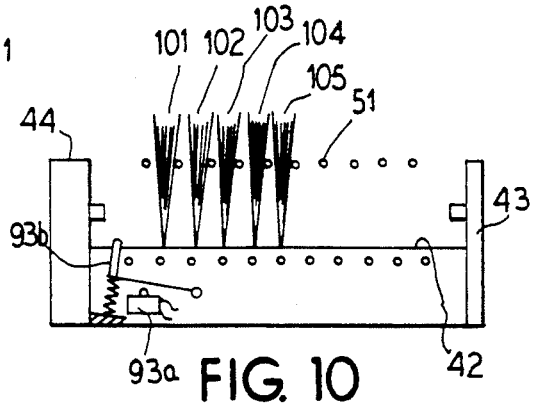
FIG. 10 illustrates an alternate limit switch of the invention.
Figure 11:
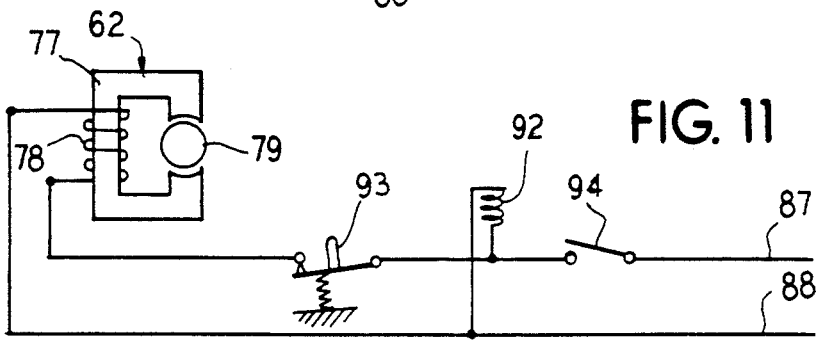
FIG. 11 illustrates an alternate electrical schematic of the invention.

FIG. 9 illustrates an electrical schematic to drive the powered version. Power leads 87 and 88 are connected to a suitable power source. Lead 88 is connected to coil 78 of the motor 62 and is mounted on a stator 77 of the motor 62. The rotor 79 of the motor has an output shaft and gear train 80 that drives a cam 81 which has an extending actuator 86 that engages a normally closed limit switch 111 which has a cam follower 82 pivotally connected to a pivot pin 83. When the extension 86 moves the cam follower 82 it will open a normally closed contact 84 so as to stop the motor. The other end of the coil 78 is connected to lead 120. Momentary actuating contacts 91 are actuated by depressing momentary advance switch 46 which applies power from lead 87 to lead 120 to start the motor 62. As soon as the motor 62 is started, the extending actuator 86 moves out of engagement with the follower 82 and the spring 116 closes contacts 84 so that power will be supplied to the motor 62 through lead 121 after the momentary advance switch 46 is released. The motor 62 will continue to run until the extending actuator 86 opens the switch 84 at which time the motor 62 will stop. Since extending actuator 86 co-rotates with hub 54 and spiral 51, it will cause a single revolution or one coil advance of the spiral 51. An alternative is shown in the circuit of FIGS. 10 and 11 wherein the lead file 101 would open a normally closed limit switch contacts 93*a* to deenergize the circuit. In the circuit of FIG. 11, power leads 87 and 88 are provided. Lead 88 connects to the winding 78 of the motor 62 and an off/on switch 94 which when closed supplies power through the limit switch 93 to the other side of the motor so that the motor continues to operate until the file 101 engages the limit switch actuator 93*b* to open the limit switch 93 at which time the motor 62 would stop. An indicator light 92 is connected across the power lead when switch 94 is closed so as to indicate on and off for the system.

FIG. 10 illustrates a number of files 101–105 on the conveyor wherein file 101 will contact switch actuator 93*b* when it moves to the left. Upon removing file 101, the motor would start running, and the spiral 51 would advance files 102–105 until file 102 depressed actuator 93*b*, stopping motor 62.

Although the invention has been described with respect to preferred embodiments, it is not to be so limited as changes and modifications can be made which are within the full intended scope of the invention as defined by the appended claims.

I claim as our Invention:

1. A file folder conveyor comprising, a base member formed with an end, a spiral rotatably supported from said end and adapted to receive files, a front planar surface and a back planar surface formed on said base on front and back sides of said spiral and adapted to slidably and horizontally support files thereon, said front and back planar surfaces are in the same horizontal plane which horizontal plane is above the bottom edge of said spiral and below the top edge of said spiral, an upwardly extending file engaging back wall attached to said base member adjacent said back planar surface such that said files rest on said front and back planar surfaces and engage said file engaging back wall and said files extend outwardly over said front planar surface away from said spiral so that said files can be moved horizontally away from said spiral, and means for driving said spiral so as to move files along said front and back planar surfaces.

2. A file folder conveyor according to claim 1 wherein said means for driving said spiral is a crank.

3. A file folder conveyor according to claim 1 wherein said means for driving said spiral is an electric motor.

4. A file folder conveyor according to claim 3 including an actuating switch connected to said electric motor to energize it.

5. A file folder conveyor according to claim 4 including a hold circuit connected to said actuating switch to cause said motor to operate for a specified rotation of said spiral.

6. A file folder conveyor according to claim 4 including a release switch connected in series with said motor and said release switch having an actuator engageable by one of said files.

7. A file folder conveyor according to claim 1 including indicia on said base member so as to indicate the status of files mounted in said spiral.

8. A file folder conveyor according to claim 1 including a second end and said spiral rotatably supported between said end and said second end.

9. A file folder conveyor according to claim 1 wherein said spiral is wound in a direction so that as it rotates it urges said files toward said upwardly extending file engaging wall.

* * * * *